US011076223B2

(12) United States Patent
Ikeda et al.

(10) Patent No.: US 11,076,223 B2
(45) Date of Patent: Jul. 27, 2021

(54) SPEAKER DEVICE

(71) Applicant: DENSO TEN Limited, Kobe (JP)

(72) Inventors: Shinichi Ikeda, Kobe (JP); Shizuka Ishigaki, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 16/717,264

(22) Filed: Dec. 17, 2019

(65) Prior Publication Data

US 2020/0275194 A1 Aug. 27, 2020

(30) Foreign Application Priority Data

Feb. 25, 2019 (JP) ..... JP2019-031849
Feb. 28, 2019 (JP) ..... JP2019-035801

(51) Int. Cl.
*H04R 1/28* (2006.01)
*H04R 17/00* (2006.01)

(52) U.S. Cl.
CPC ..... *H04R 1/2834* (2013.01); *H04R 1/2857* (2013.01); *H04R 17/00* (2013.01)

(58) Field of Classification Search
CPC .... H04R 1/2834; H04R 1/2857; H04R 17/00; H04R 7/04; H04R 7/045; H04R 7/06; H04R 7/08; H04R 7/10; H04R 2217/00; H04R 2217/01; H04R 2440/05; H04R 2440/07; H01L 41/0926; H01L 41/0933; H01L 41/0946; H01L 41/096; H01L 41/0973
USPC ..... 381/332, 190, 431
See application file for complete search history.

(56) References Cited

U.S. PATENT DOCUMENTS 7,639,826 B1 * 12/2009 Azima ..... H04R 7/045 381/152
2006/0093165 A1 * 5/2006 Kamimura ..... H04R 7/045 381/152
2008/0273720 A1 * 11/2008 Johnson ..... H04R 17/00 381/190
2012/0057728 A1 * 3/2012 Fujise ..... H04R 17/00 381/162
2014/0270193 A1 * 9/2014 Jones ..... H04R 17/005 381/27
2019/0141450 A1 * 5/2019 Yoon ..... H04R 7/045

FOREIGN PATENT DOCUMENTS

JP 2014-127794 A 7/2014
WO WO-2007136162 A1 * 11/2007 ..... H04R 17/00

* cited by examiner

*Primary Examiner* — Fan S Tsang
*Assistant Examiner* — Daniel R Sellers
(74) *Attorney, Agent, or Firm* — Oliff PLC

(57) ABSTRACT

A speaker device in an embodiment includes a panel and an actuator. The actuator is provided on the panel. The actuator includes a diaphragm, a piezoelectric element, and a vibration transmission portion. The piezoelectric element is provided on at least one of principal surfaces of the diaphragm. The vibration transmission portion is provided on the diaphragm and abuts the panel without making contact with the piezoelectric element.

20 Claims, 16 Drawing Sheets

SPEAKER DEVICE

CROSS-REFERENCE TO RELATED APPLICATIONS

This application is based upon and claims the benefit of priority of the prior Japanese Patent Application No. 2019-031849, filed on Feb. 25, 2019 and Japanese Patent Application No. 2019-035801, filed on Feb. 28, 2019, the entire contents of both of which are incorporated herein by reference.

FIELD

The embodiments discussed herein are directed to a speaker device.

BACKGROUND

Conventionally, an actuator using a volumetric strain of a piezoelectric element by applying a voltage, what is called an inverse piezoelectric effect, has been known (for example, see Japanese Laid-open Patent Publication No. 2014-127794). Such an actuator can, by being attached to, for example, the back surface of a panel such as a display and driven, vibrate the panel and cause such a panel to function as a diaphragm of a speaker.

However, in the above-described conventional technology, there has been room for further improvement in improving the vibration characteristics of the panel.

For example, in the above-described technology, the panel is vibrated by following the expansion and contraction of the piezoelectric element by the volumetric strain and making the panel warp. However, as compared with making the panel vibrate directly but not by following, a loss in vibration transmission is likely to occur and the vibration in an opposite phase is likely to arise. Accordingly, when the panel is made to function as a speaker device, it caused the deterioration in sound-pressure frequency characteristics, for example.

Furthermore, when the attaching position to the back surface of the panel is not appropriate for example, it was not possible to vibrate the panel efficiently and it also caused the vibration characteristics to deteriorate.

SUMMARY

A speaker device according to an embodiment a panel and an actuator. The actuator is provided on the panel. The actuator includes a diaphragm, a piezoelectric element, and a vibration transmission portion. The piezoelectric element is provided on at least one of principal surfaces of the diaphragm. The vibration transmission portion is provided on the diaphragm and abuts the panel without making contact with the piezoelectric element.

BRIEF DESCRIPTION OF DRAWINGS

A more complete appreciation of the present disclosure and many of the attendant advantages thereof will be readily obtained as the same becomes better understood by reference to the following detailed description when considered in connection with the accompanying drawings, wherein.

DESCRIPTION OF EMBODIMENTS

With reference to the accompanying drawings, the following describes exemplary embodiments of a speaker device disclosed in the present application in detail. The invention, however, is not intended to be limited by the following embodiments.

Furthermore, in the following description, a case in which an actuator is provided on, for example, a display panel such as an organic electro-luminescence (EL) display that needs no backlight and in which such a display is made to function as a display speaker will be exemplified. The display speaker corresponds to one example of a speaker device.

In each drawing used in the following description, in order to facilitate the understanding of explanation, a three-dimensional Cartesian coordinate system may be illustrated.

In such a Cartesian coordinate system, a principal surface direction of plate-like members such as a panel, a piezoelectric element, and a diaphragm is defined as an X-Y plane direction, and the thickness direction of those plate-like members is defined as a Z-axis direction.

Note that "principal surface" refers to a principal surface on the front or back of a plate-like member excluding side surfaces that are the surfaces along the thickness direction of the plate-like member and the principal surface direction refers to the direction of a plane of the principal surface. Furthermore, in the following description, the description assumes as a front direction when viewed from a positive direction of the Z-axis.

First Embodiment

Figure 1:
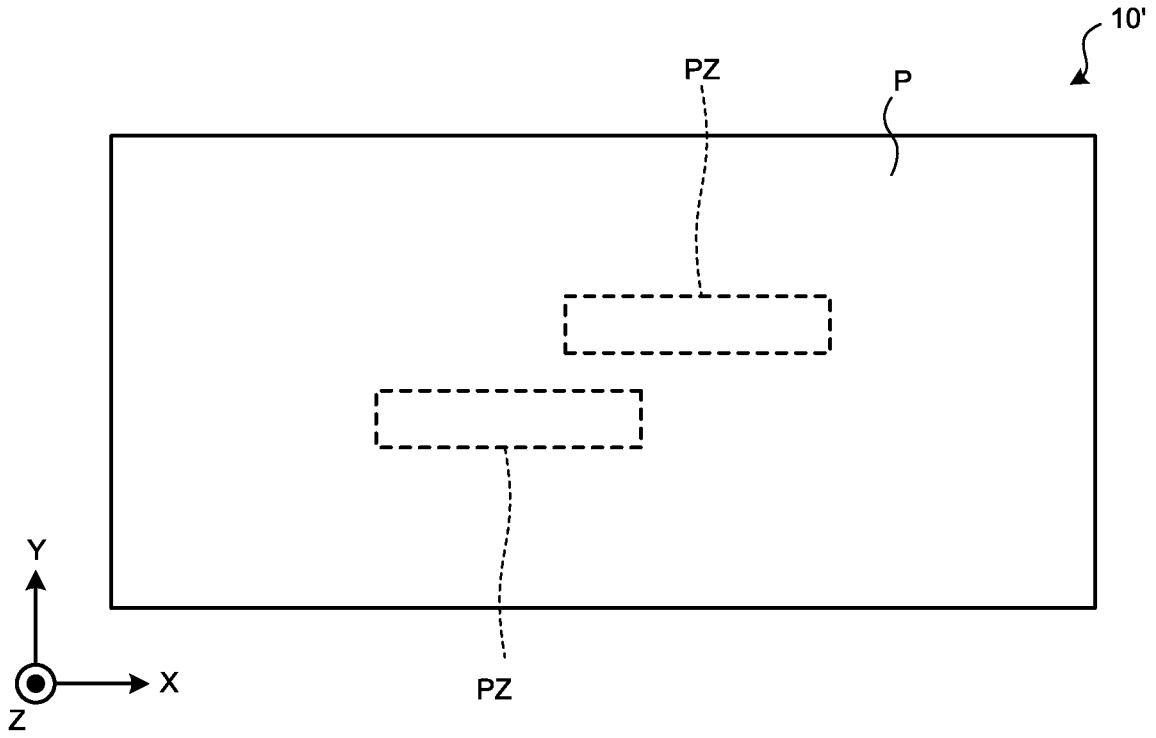
FIG. 1 is a schematic front view illustrating an overview of a display speaker according to a comparative example.
Figure 2:
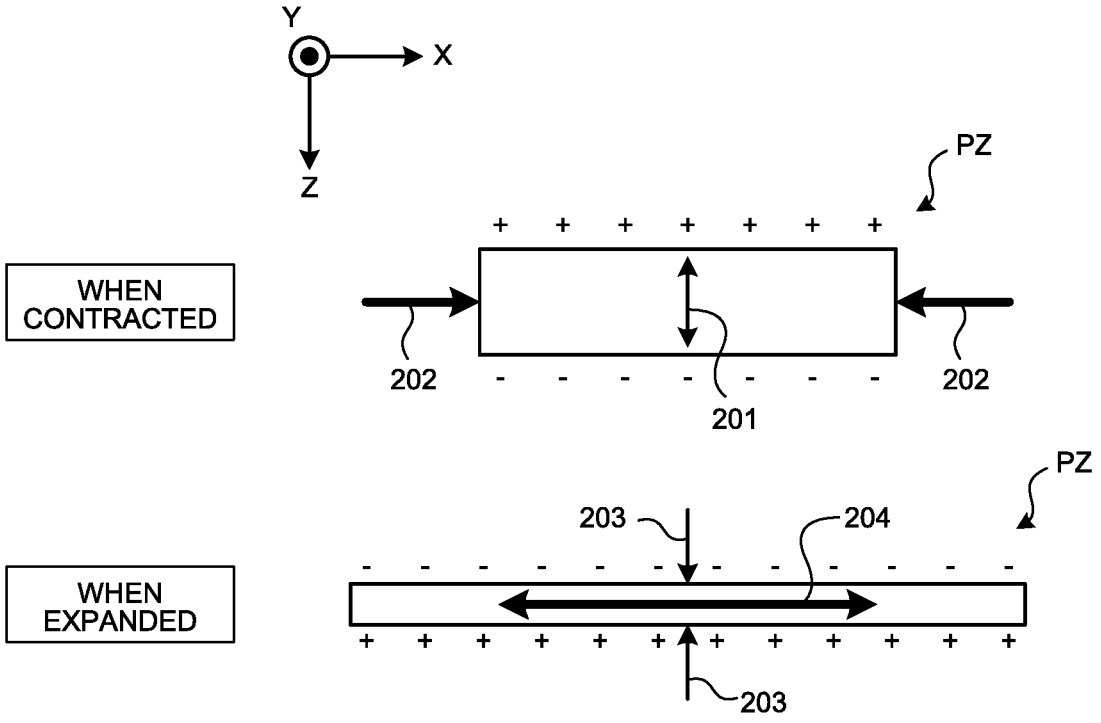
FIG. 2 is an explanatory diagram of a driving principle of a piezoelectric element.
Figure 3:
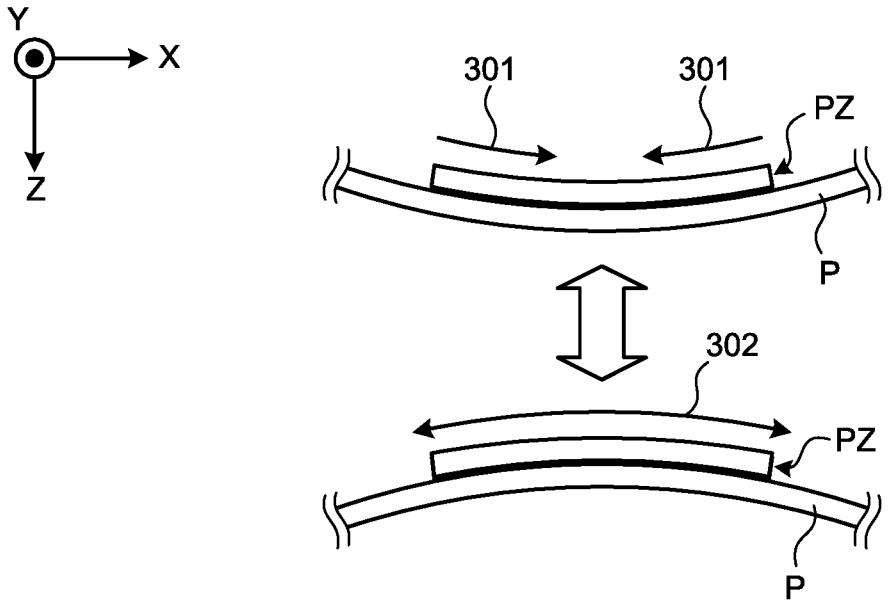
FIG. 3 is an explanatory diagram of the operation of a panel in the comparative example.

Before describing from a first embodiment, an overview of a configuration of a display speaker 10' according to a comparative example will be described first. FIG. 1 is a schematic front view illustrating an overview of the display speaker 10' according to the comparative example. FIG. 2 is an explanatory diagram of a driving principle of a piezoelectric element PZ. FIG. 2 presents the thickness of the piezoelectric element PZ in an exaggerated manner. FIG. 3 is an explanatory diagram of the operation of a panel P in the comparative example.

As illustrated in FIG. 1, the display speaker 10' in the comparative example includes a panel P and piezoelectric elements PZ. The panel P is a display panel of an organic EL display, for example.

The piezoelectric element PZ is what is called a piezoelectric element and, on the basis of an element for which a piezoelectric material such as a specific ceramic is sandwiched by two electrodes, has various structures such as unimorph type.

In the display speaker 10' in the comparative example, for example, two pieces of such piezoelectric elements PZ are provided on the back surface of the panel P by being attached to symmetrical positions with respect to an entire surface of the panel P. Then, the display speaker 10' vibrates the panel P by utilizing a phenomenon, what is called an inverse piezoelectric effect, of deforming a piezoelectric material when a voltage is applied to those piezoelectric elements PZ, and outputs a sound by using the panel P as a diaphragm.

Specifically, as illustrated in FIG. 2, the piezoelectric element PZ is subjected to a polarizing process in advance in the Z-axis direction that is the thickness direction, for example, and when a voltage from the outside is applied in a direction of such polarization, the entire element expands and contracts in the polarization direction and the thickness increases and decreases.

However, because the volume is unchanged, the piezoelectric element PZ contracts (see arrows 202 in FIG. 2) in the X-axis direction perpendicular to the polarization direction, when the piezoelectric element PZ expands (see an arrow 201 in FIG. 2) in the polarization direction, for example. When the piezoelectric element PZ contracts (see arrows 203 in FIG. 2) in the polarization direction, the piezoelectric element PZ expands (see an arrow 204 in FIG. 2) in the X-axis direction perpendicular to the polarization direction.

In the display speaker 10' in the comparative example, the piezoelectric elements PZ thus expand and contract and are attached to the back surface of the panel P as in the foregoing, but the panel P itself neither expands nor contracts. For this reason, as illustrated in FIG. 3, the expansion and contraction of the piezoelectric element PZ (see arrows 301, 302 in FIG. 3) become a force to warp the entire panel P that neither expands nor contracts. That is, due to the difference in expansion and contraction between the piezoelectric element PZ and the panel P, vibration occurs in the panel P.

However, when the panel P is thus made to vibrate by warping the panel P following the expansion and contraction of the piezoelectric elements PZ, a loss in vibration transmission is likely to occur and the vibration in an opposite phase is likely to arise. Consequently, according to the display speaker 10' in the comparative example, due to the cancellation of sound by the vibration in such an opposite phase, it is likely to cause deterioration in the sound-pressure frequency characteristics.

Hence, a display speaker 10 according to the first embodiment vibrates the panel P by an actuator 11. The actuator 11 includes a diaphragm 111, the piezoelectric elements PZ, and a vibration transmission portion 112.

The diaphragm 111 is arranged such that the principal surfaces are substantially parallel to the back surface of the panel P. The piezoelectric element PZ is provided on at least one of the principal surfaces of the diaphragm 111. The vibration transmission portion 112 is provided so as to extend from the diaphragm 111 without making contact with the piezoelectric element PZ and abut the back surface of the panel P.

Figure 4:
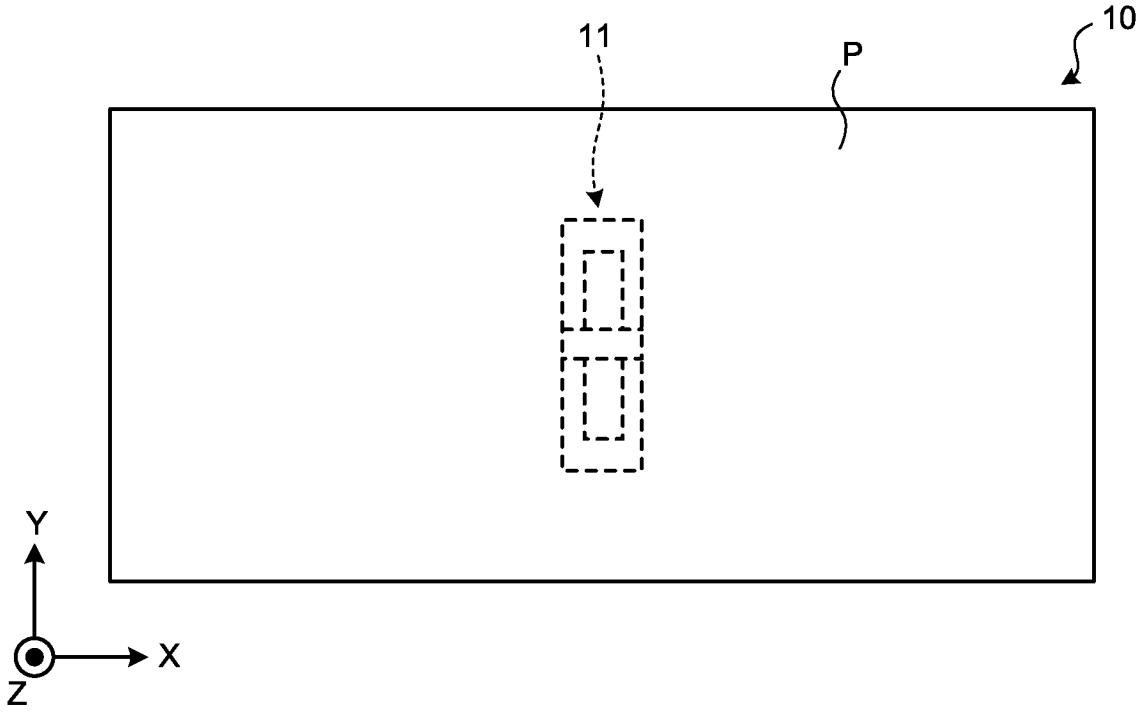
FIG. 4 is a schematic front view illustrating an overview of a configuration of a display speaker according to a first embodiment.
Figure 5:
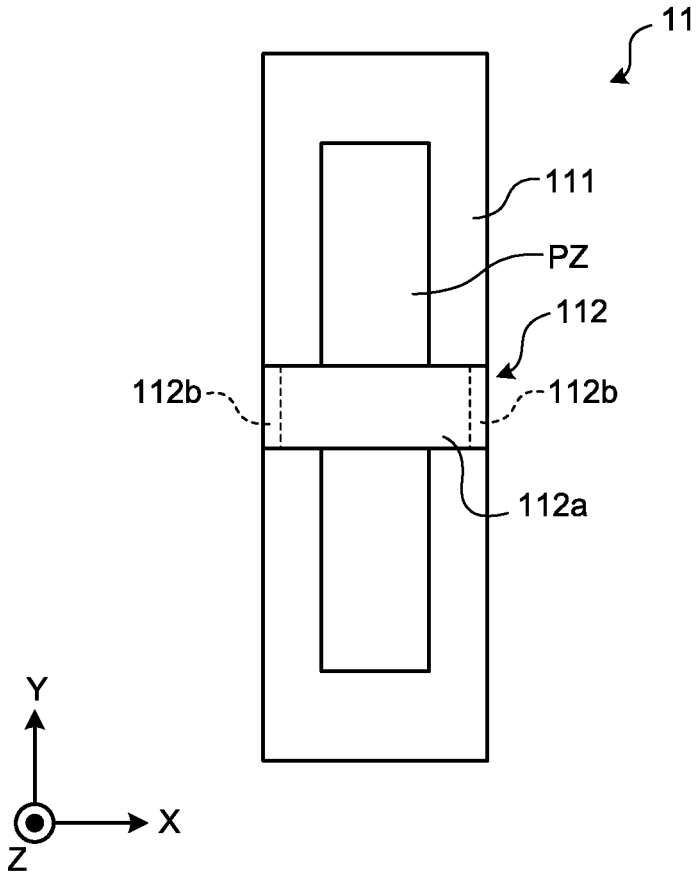
FIG. 5 is a schematic front view of an actuator in the first embodiment.
Figure 6:
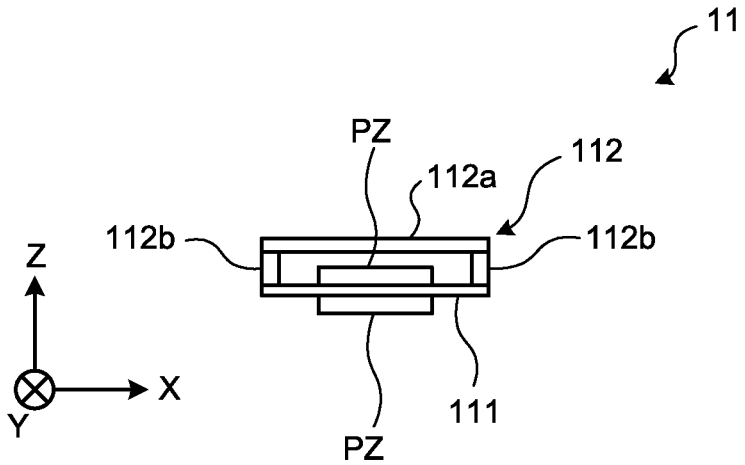
FIG. 6 is a schematic bottom plan view of the actuator in the first embodiment.

In the following description, a specific configuration example of the display speaker 10 in the first embodiment will be described with reference to FIG. 4 to FIG. 12. FIG. 4 is a schematic front view illustrating an overview of the configuration of the display speaker 10 in the first embodiment. FIG. 5 is a schematic front view of the actuator 11 in the first embodiment. FIG. 6 is a schematic bottom plan view of the actuator 11 in the first embodiment.

Figure 7:
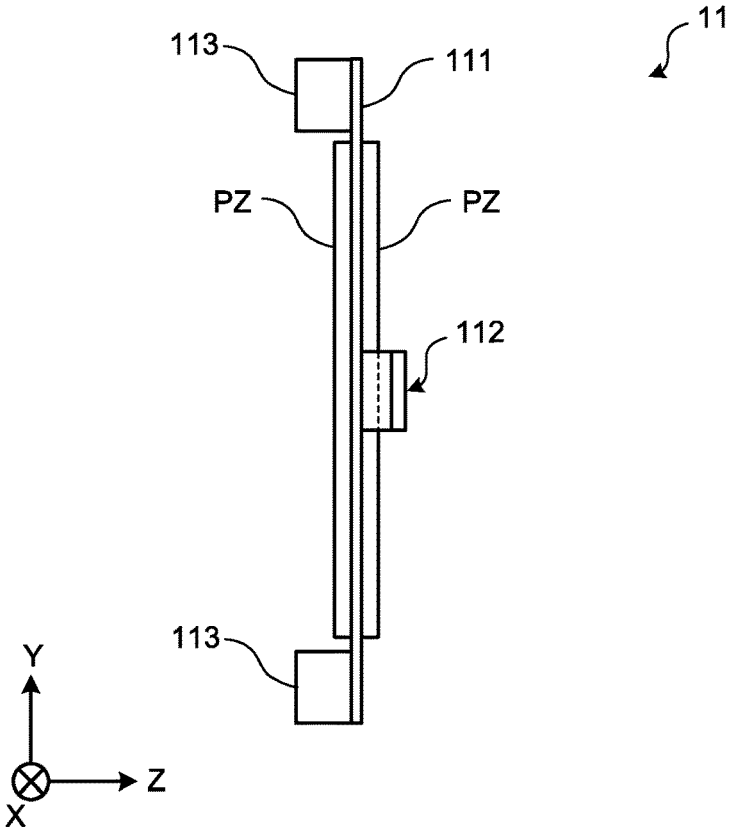
FIG. 7 is a schematic side view of the actuator in the first embodiment.
Figure 8:
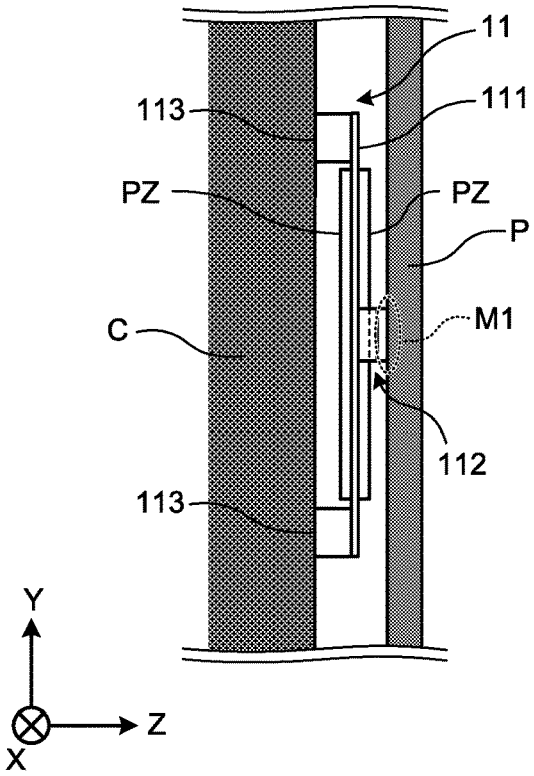
FIG. 8 is a diagram illustrating an arrangement example of the actuator in the first embodiment.
Figure 9:
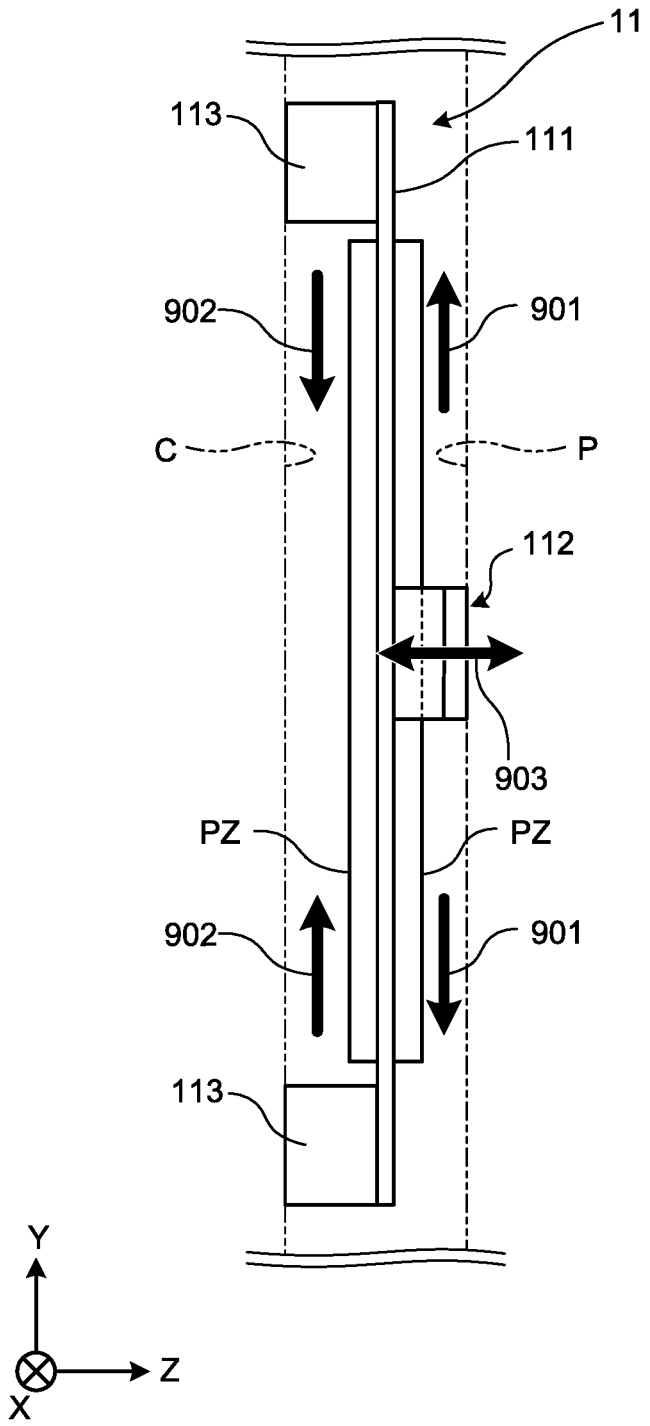
FIG. 9 is an explanatory diagram of the operation of the actuator in the first embodiment.

FIG. 7 is a schematic side view of the actuator 11 in the first embodiment. FIG. 8 is a diagram illustrating an arrangement example of the actuator 11 in the first embodiment. FIG. 9 is an explanatory diagram of the operation of the actuator 11 in the first embodiment.

Figure 10:
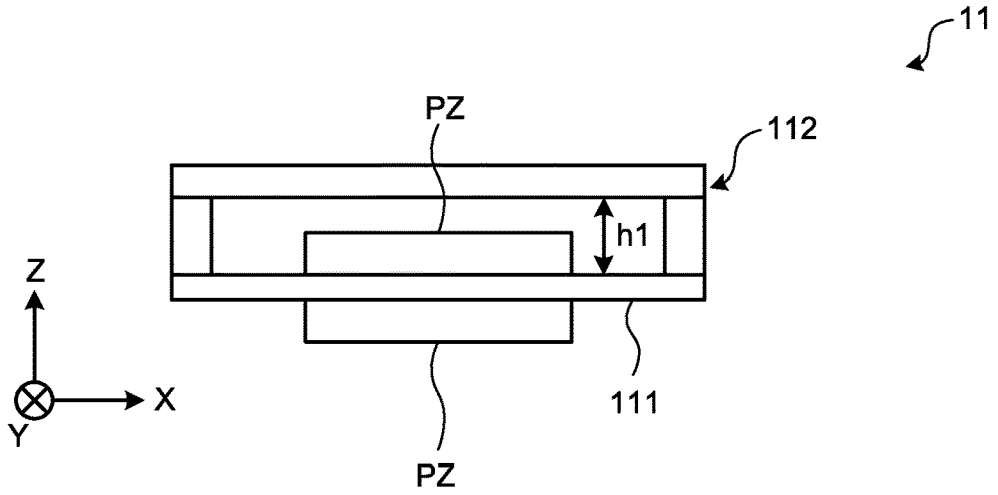
FIG. 10 is an explanatory diagram of measurements of a vibration transmission portion in the first embodiment.
Figure 11:
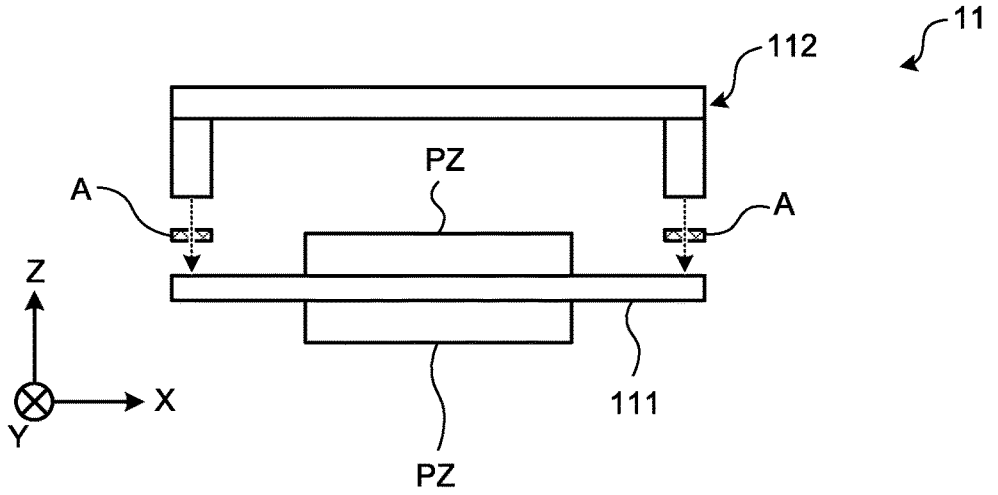
FIG. 11 and FIG. 12 are diagrams (part 1 and part 2) illustrating examples of attaching the vibration transmission portion in the first embodiment.
Figure 12:
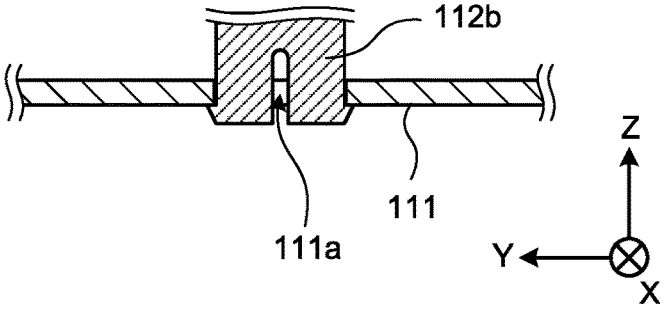

FIG. 10 is an explanatory diagram of measurements of the vibration transmission portion 112 in the first embodiment. FIG. 11 and FIG. 12 are diagrams (part 1 and part 2) illustrating examples of attaching the vibration transmission portion 112 in the first embodiment.

As illustrated in FIG. 4, the display speaker 10 in the first embodiment includes the actuator 11. A single piece of the actuator 11 is provided, for example, in the central portion of the back surface of the panel P.

Specifically, as illustrated in FIG. 5 and FIG. 6, the actuator 11 includes the diaphragm 111, the piezoelectric elements PZ, and the vibration transmission portion 112. The diaphragm 111 is a plate-like member having the longitudinal direction in the Y-axis direction and the lateral direction in the X-axis direction and is formed of glass epoxy and the like as raw material.

The piezoelectric elements PZ are provided, as illustrated in FIG. 5 and FIG. 6, on each of the principal surfaces of the diaphragm 111 while lying along the extending direction of the diaphragm 111, for example. The piezoelectric elements PZ are attached to the diaphragm 111 by using an adhesive material such as an adhesive agent, a double-sided adhesive tape, and the like.

Note that the diaphragm 111 is provided such that the area of its principal surface is greater than the area of the principal surface of the piezoelectric element PZ. Thus, as illustrated in FIG. 5, in the diaphragm 111, in a state where the piezoelectric element PZ is provided, an area of non-contact with the piezoelectric element PZ (hereinafter may also be referred to as "margin area") is formed in the periphery of the piezoelectric element PZ.

The vibration transmission portion 112 is provided, in the principal surface of the diaphragm 111 on the side facing the back surface of the panel P, so as to extend from the margin area and abut the back surface of the panel P. For example, as illustrated in FIG. 5 and FIG. 6, the vibration transmission portion 112 is formed in a bridge-like shape, in other words, in a substantially U-like shape in longitudinal sectional view of the X-Z plane, and a single portion of the vibration transmission portion 112 is provided at the central portion in the longitudinal direction of the diaphragm 111.

As illustrated in FIG. 5 and FIG. 6, as the vibration transmission portion 112 is formed in a bridge-like shape, the vibration transmission portion 112 is made up of three members of a horizontal portion 112*a* and a pair of leg portions 112*b*, for example.

Furthermore, as illustrated in FIG. 7, the actuator 11 further includes a pair of supporting portions 113. The supporting portions 113 are members to support the diaphragm 111 and are each provided at the margin area on both end portions in the longitudinal direction (Y-axis direction) on the principal surface of the diaphragm 111 on the opposite side to the side where the vibration transmission portion 112 is provided.

Then, as illustrated in FIG. 8, the actuator 11 is provided so as to interpose between a chassis C of the display speaker 10 and the panel P, and the supporting portions 113 are attached to the chassis C by using an adhesive material such as an adhesive agent, a double-sided adhesive tape, and the like. Meanwhile, the vibration transmission portion 112 is, as illustrated in an M1 portion in FIG. 8, provided so as to abut the back surface of the panel P.

Then, in the actuator 11 thus arranged, as illustrated in FIG. 9, a voltage is applied to the piezoelectric elements PZ provided on each of the principal surfaces of the diaphragm 111, at the time of driving, such that the phases are opposite to each other on both such surfaces. That is, the pair of piezoelectric elements PZ is driven so that, when one side is expanding along the Y-axis direction, the other side is contracting along the Y-axis direction (see arrows 901, 902 in FIG. 9).

As a result, the diaphragm 111 can be made to warp more easily by following the expansion and contraction of the piezoelectric elements PZ, and the driving force of the actuator 11 can be increased.

Furthermore, as the vibration transmission portion 112 is abutting the back surface of the panel P, the vibration transmission portion 112 converts the expansion and contraction of the piezoelectric elements PZ lying along the longitudinal direction (Y-axis direction) of the piezoelectric elements PZ into vibration of a direction perpendicular to the plane (Z-axis direction) and transmits it to the back surface of the panel P (see an arrow 903 in FIG. 9).

In other words, the vibration transmission portion 112 gathers in the center of the diaphragm 111 the vibration that is converted into the direction perpendicular to the plane as the diaphragm 111 warps by following the expansion and contraction of the piezoelectric elements PZ, and transmits it to the back surface of the panel P.

Accordingly, the occurrence of vibration in an opposite phase in the panel P can be reduced. That is, the sound pressure frequency characteristics of the panel P can be improved.

Note that, as illustrated in FIG. 10, the height measurement h1 of the vibration transmission portion 112 is set to a height not abutting the piezoelectric element PZ even when the piezoelectric element PZ reaches the maximum displacement position. As a result, the transmission of the vibration to the panel P can be prevented from being hindered as the vibration transmission portion 112 and the piezoelectric element PZ come in contact when driving.

Note that, as illustrated in FIG. 11, the vibration transmission portion 112 can be attached to the diaphragm 111 by using an adhesive material A such as an adhesive agent, a double-sided adhesive tape, and the like. In addition to this, as illustrated in FIG. 12, the vibration transmission portion 112 can be attached to the diaphragm 111 by insertion, for example.

In FIG. 12, illustrated is an example in which the vibration transmission portion 112 is attached to the diaphragm 111, by forming the leg portion 112*b* of the vibration transmission portion 112 so as to spread in a free state for example, and by fitting it in a fitting hole 111*a* formed in the diaphragm 111 in advance.

Modifications of Vibration Transmission Portion 112

Figure 13:
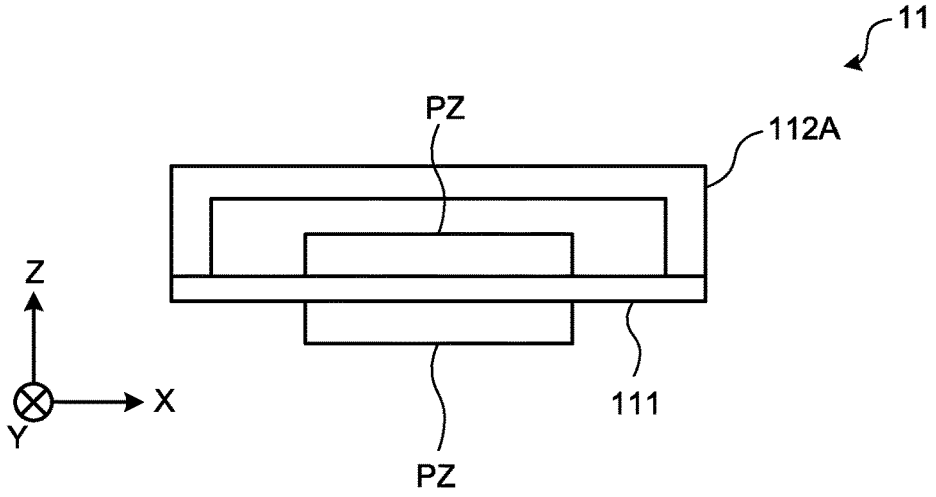
FIG. 13 is a diagram illustrating a configuration of a vibration transmission portion according to a first modification.
Figure 14:
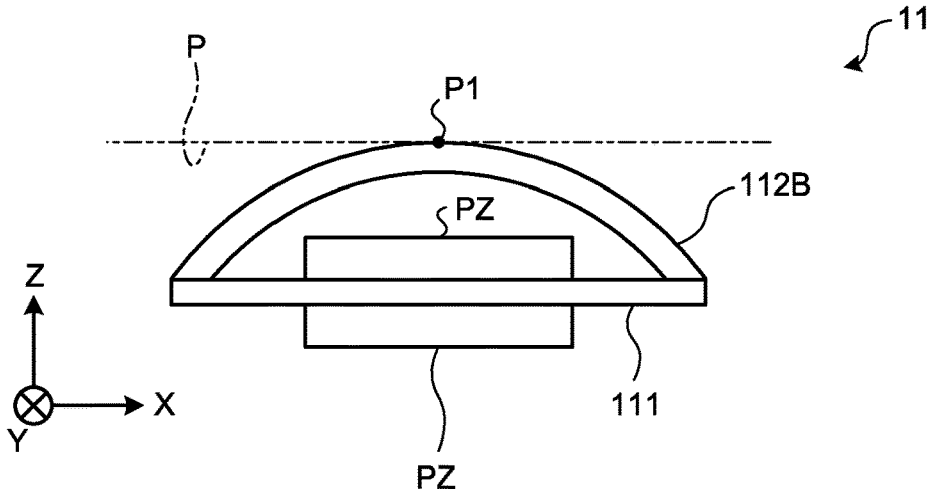
FIG. 14 is a diagram illustrating a configuration of a vibration transmission portion according to a second modification.
Figure 15:
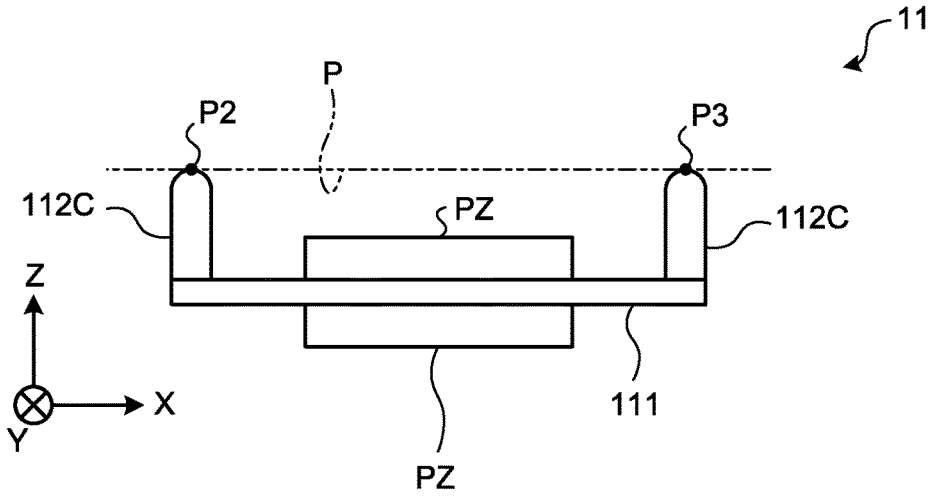
FIG. 15 is a diagram illustrating a configuration of a vibration transmission portion according to a third modification.

Next, with reference to FIG. 13 to FIG. 15, modifications of the vibration transmission portion 112 will be described. FIG. 13 is a diagram illustrating a configuration of a vibration transmission portion 112A according to a first modification. FIG. 14 is a diagram illustrating a configuration of a vibration transmission portion 112B according to a second modification. FIG. 15 is a diagram illustrating a configuration of a vibration transmission portion 112C according to a third modification.

Until now, it has been exemplified that the vibration transmission portion 112 is made up of three members of the horizontal portion 112*a* and a pair of the leg portions 112*b*. However, as illustrated in FIG. 13, the vibration transmission portion 112A in the first modification can be configured as a single bridge-like member. According to such a vibration transmission portion 112A in the first modification, a loss of vibration transmission attributable to errors in a process of combining a plurality of members can be suppressed.

Furthermore, until now, it has been exemplified that the vibration transmission portions 112 and 112A are formed in a substantially U-like shape in a longitudinal sectional view of the X-Z plane, and are brought into surface contact with the panel P by the horizontal portion 112*a* for example. However, the embodiments are not limited thereto.

For example, as illustrated in FIG. 14, the vibration transmission portion 112B in the second modification is formed in a substantially arch-like shape in a longitudinal sectional view of the X-Z plane. That is, the vibration transmission portion 112B may be formed such that a top portion making contact with the back surface of the panel P is in an R shape and is brought into point contact with the back surface of the panel P.

As a result, the vibration transmission portion 112E can transmit the vibration intensively to a point P1 in FIG. 14, and can contribute to accurately transmitting the vibration of low-frequency components of the sound, for example.

Furthermore, until now, it has been exemplified that the vibration transmission portions 112, 112A, and 112B are formed in a bridge-like shape. However, the embodiments are not limited thereto.

For example, as illustrated in FIG. 15, the vibration transmission portion 112C in the third modification is formed as a plurality of protrusions that project from the diaphragm 111 and that each distal end portion thereof is in an R shape. FIG. 15 illustrates an example in which the vibration transmission portion 112C is brought into point contact with the back surface of the panel P at points P2 and P3.

As a result, the vibration transmission portion 112C can transmit the vibration intensively to the points P2 and P3 that are brought into point contact, and can contribute to accurately transmitting the vibration of low-frequency components of the sound, for example. Furthermore, the vibration transmission portion 112C can transmit the stable and concentrated vibration by a plurality of point contact.

In FIG. 14 and FIG. 15, the vibration transmission portions 112B and 112C are brought into point contact with the back surface of the panel P but may be brought into surface contact.

As in the foregoing, the actuator 11 in the first embodiment is an actuator provided on the panel P and includes the diaphragm 111, the piezoelectric elements PZ, and the vibration transmission portion 112, 112A, 112B, or 112C. The piezoelectric element PZ is provided on at least one of the principal surfaces of the diaphragm 111. The vibration transmission portion 112, 112A, 112B, or 112C is provided on the diaphragm 111 and abuts the back surface of the panel P without making contact with the piezoelectric element PZ.

Thus, according to the actuator 11 in the first embodiment, the vibration characteristics of the panel P can be improved.

Furthermore, the piezoelectric elements PZ are provided on each of the principal surfaces of the diaphragm 111, and a voltage is applied to the piezoelectric element PZ such that the phases of vibration of the principal surfaces are opposite to each other at a time of driving. Consequently, according to the actuator 11 in the first embodiment, the driving force can be improved.

Furthermore, at least one vibration transmission portion 112 is provided in the center of the diaphragm 111. Thus, according to the actuator 11 in the first embodiment, the panel P can be made to vibrate efficiently, and the vibration characteristics of the panel P can be improved.

Furthermore, the vibration transmission portions 112 and 112A are formed in a substantially U-like shape. Thus, according to the actuator 11 in the first embodiment, the vibration can be transmitted to the panel P efficiently and the vibration characteristics of the panel P can be improved.

Furthermore, the vibration transmission portion 112B is formed in a substantially arch-like shape. As a result, according to the actuator 11 in the first embodiment, the vibration can be transmitted to the contact point intensively, and that can contribute to accurately transmitting the vibration of low-frequency components of the sound, for example. In addition, due to a substantially arch-like shape, the rigidity of the vibration transmission portion 112B can be improved.

Furthermore, the vibration transmission portion 112C is formed as a plurality of protrusions projecting from the diaphragm 111. As a result, according to the actuator 11 in the first embodiment, the vibration can be transmitted to the contact points intensively, and that can contribute to accurately transmitting the vibration of low-frequency components of the sound, for example. In addition, the stable and concentrated vibration can be transmitted due to a plurality of point contact, the panel P can be made to vibrate efficiently without a loss, and the vibration characteristics of the panel P can be improved.

Moreover, the vibration transmission portion 112 is provided at the center in the longitudinal direction of the diaphragm 111 and, on the shorter side of the rear surface side of the vibration transmission portion 112 or 112A, in other words, on the surface side facing the diaphragm 111 at both end portions in the longitudinal direction of the vibration transmission portion 112, the leg portions 112*b* are provided. Consequently, according to the actuator 11 in the first embodiment, the vibration of the diaphragm 111 can be transmitted to the panel P in a well-balanced manner.

Figure 16:
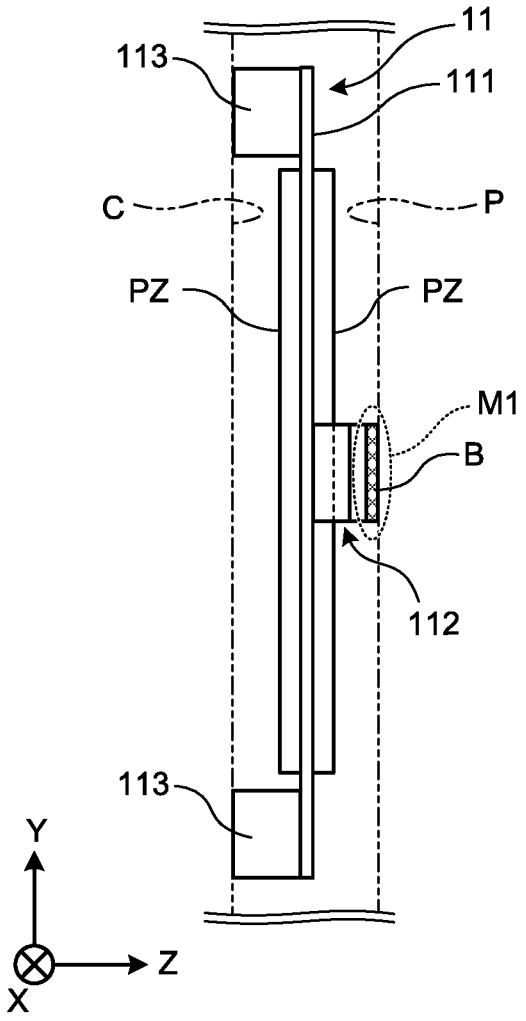
FIG. 16 is a schematic side view of the actuator when a buffering member is interposed.

Until now, it has been exemplified that the vibration transmission portions 112, 112A, 112B, and 112C are abutting the back surface of the panel P. However, the embodiments are not limited thereto. FIG. 16 is a schematic side view of the actuator 11 when a buffering member B is interposed.

That is, as illustrated in an M1 portion in FIG. 16, the actuator 11 can interpose the buffering member B between the vibration transmission portion 112 (112A, 112B, 112C) and the back surface of the panel P. As a result, it can have an effect such as prevention of chattering.

Figure 17:
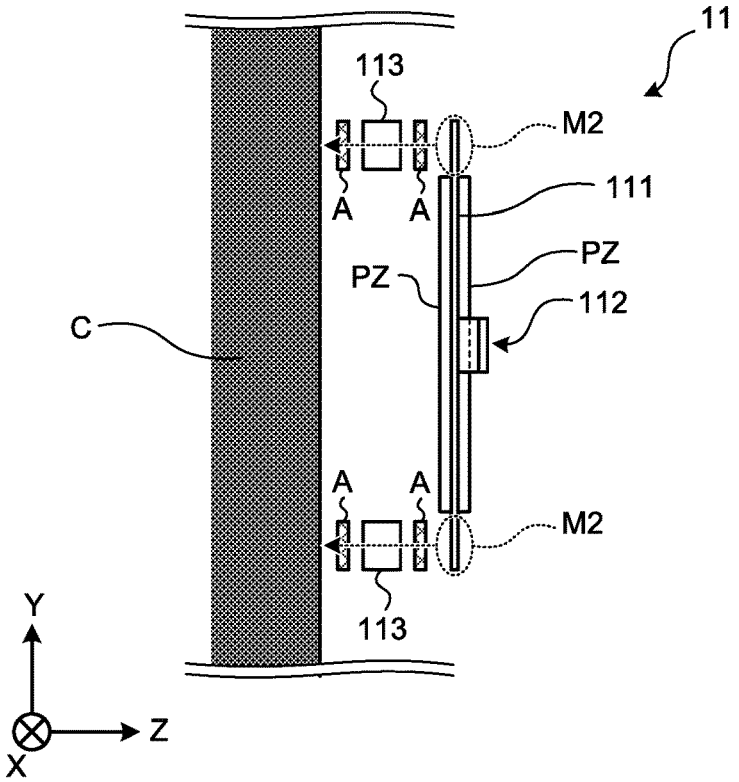
FIG. 17 is a schematic side view illustrating an overview of attaching the actuator with respect to a chassis in the first embodiment.

As has been illustrated in FIG. 16, FIG. 8, and the like, the actuator 11 in the first embodiment is provided so as to interpose between the chassis C of the housing of the display speaker 10 and the panel P. With reference to FIG. 17, an overview of attaching the actuator 11 with respect to the chassis C will be described.

FIG. 17 is a schematic side view illustrating the overview of attaching the actuator 11 with respect to the chassis C in the first embodiment.

When attaching the actuator 11 with respect to the chassis C, there is a need to ensure a space (hereinafter may be referred to as "vibration space") for the diaphragm 111 to vibrate without being disturbed. Accordingly, as illustrated in FIG. 17 for example, it only needs to support each margin area (see M2 portions in FIG. 17) of both end portions in the longitudinal direction (Y-axis direction) of the diaphragm 111 by the supporting portions 113 that function as spacers to ensure the vibration space. In such a case, the supporting portions 113 are fixed between the chassis C and the M2 portions by using the adhesive material A such as an adhesive agent, a double-sided adhesive tape, and the like.

Second Embodiment

The actuator 11 may be, by providing a positioning portion C1 that positions the actuator 11 to an appropriate predetermined position with respect to the chassis C, attached to the chassis C via such a positioning portion C1. The following describes such a case as a second embodiment. Note that a display speaker according to the second embodiment is denoted by a reference sign "10A" (see FIG. 19).

Figure 18:
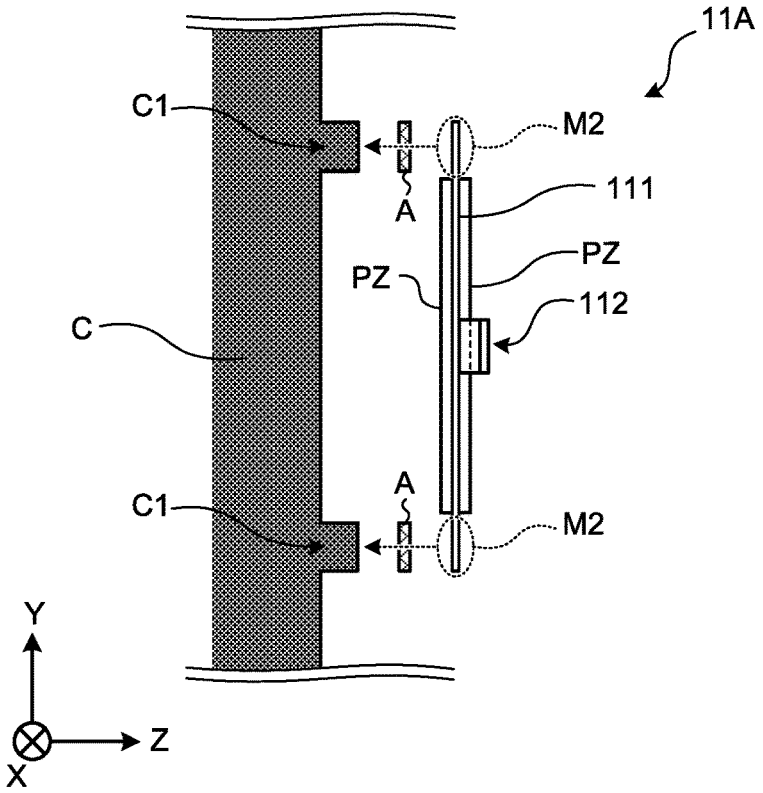
FIG. 18 is a schematic side view illustrating an overview of attaching an actuator with respect to a chassis according to a second embodiment.

FIG. 18 is a schematic side view illustrating an overview of attaching an actuator 11A with respect to the chassis C in the second embodiment.

Specifically, the positioning portion C1 is provided, at the predetermined position in the chassis C, so as to project from the chassis C, for example. Such a predetermined position is an attaching position of the actuator 11A where the actuator 11A can vibrate the panel P most efficiently, for example, and is set in advance by experiments and the like. Furthermore, so as to correspond to the above-described M2 portions of the diaphragm 111, two positioning portions C1 are provided, for example.

The actuator 11A is attached to an appropriate predetermined position of the chassis C by fixing such M2 portions to the chassis C by using the adhesive material A. In addition, because the positioning portions C1 are provided projecting from the chassis C, the actuator 11A can ensure the above-described vibration space.

According to such an attaching method in the second embodiment, as compared with the first embodiment, because the number of components can be reduced and the adhesive material A can be a single layer but not two layers, it can contribute to the cost reduction and the suppression of deterioration in vibration characteristics.

The more specific configuration of the positioning portion C1 will be described later with reference to FIG. 21 to FIG. 26.

Figure 19:
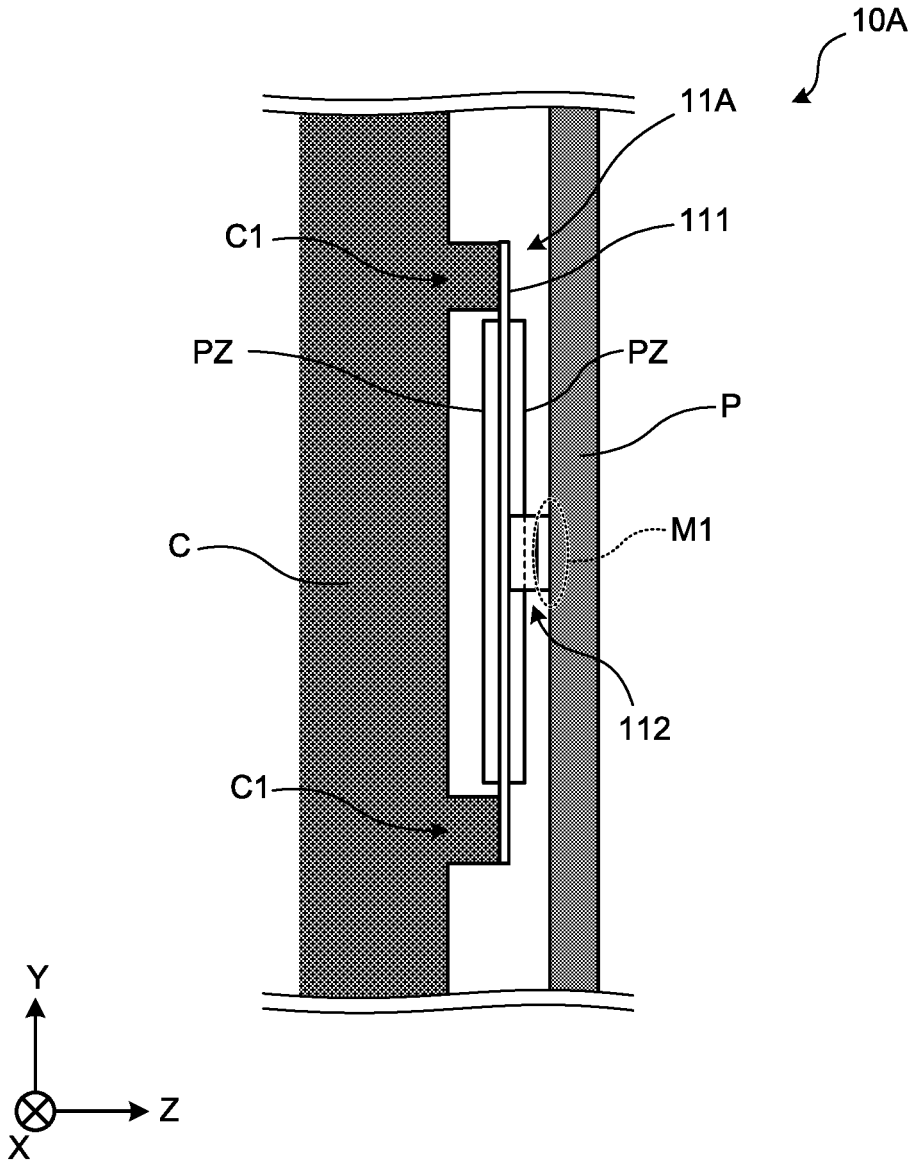
FIG. 19 is a diagram illustrating an arrangement example of the actuator in the second embodiment.
Figure 20:
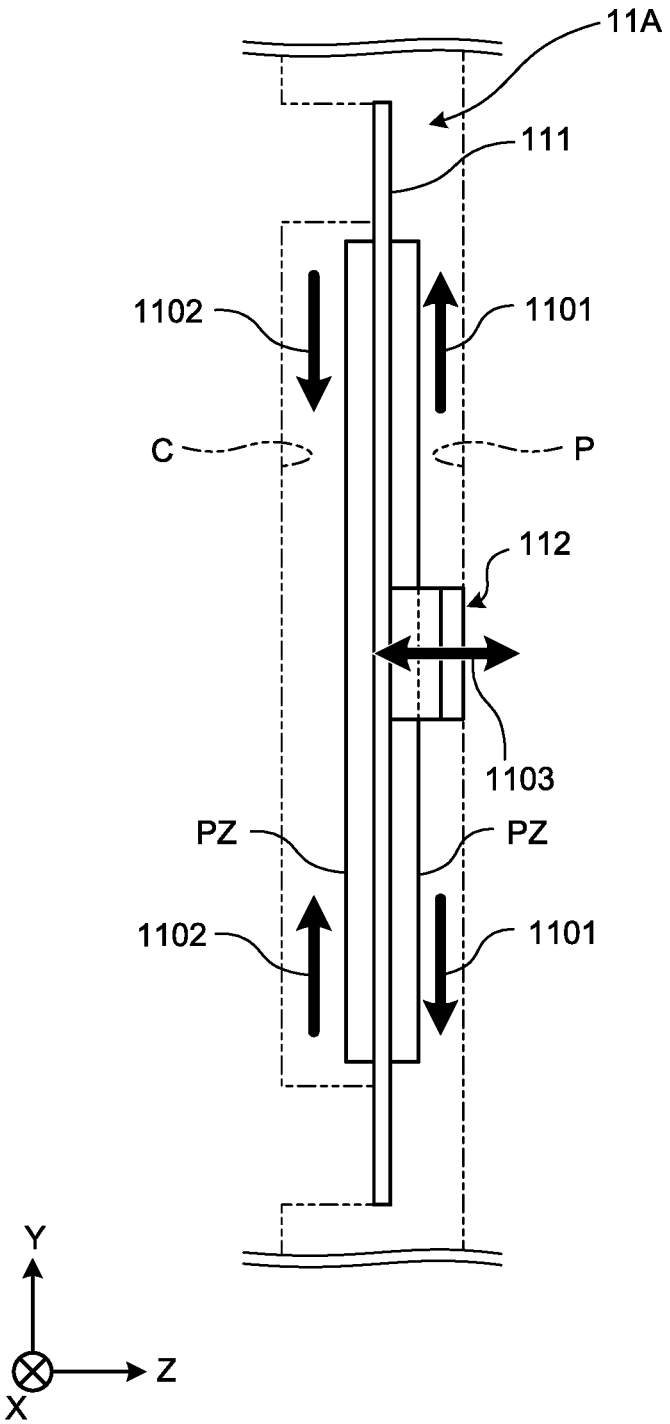
FIG. 20 is an explanatory diagram of the operation of the actuator in the second embodiment.

Next, FIG. 19 is a diagram illustrating an arrangement example of the actuator 11A in the second embodiment. FIG. 20 is an explanatory diagram of the operation of the actuator 11A in the second embodiment. As has been described already, the actuator 11A is provided so as to interpose between the chassis C and the panel P.

Specifically, as illustrated in FIG. 19, the actuator 11A is provided so as to interpose between the chassis C of the display speaker 10 and the panel P, and the positioning portions C1 support the diaphragm 111 while ensuring the above-described vibration space. Meanwhile, the vibration transmission portion 112 is, as illustrated in an M1 portion in FIG. 19, provided so as to abut the back surface of the panel P.

Then, in the actuator 11A thus arranged, as illustrated in FIG. 20, a voltage is applied to the piezoelectric elements PZ provided on each of the principal surfaces of the diaphragm 111, at the time of driving, such that the phases are opposite to each other on both such surfaces. That is, the pair of piezoelectric elements PZ is driven so that, when one side is expanding along the Y-axis direction, the other side is contracting along the Y-axis direction (see arrows 1101, 1102 in FIG. 20).

As a result, the diaphragm 111 can be made to warp more easily by following the expansion and contraction of the piezoelectric elements PZ, and the driving force of the actuator 11A can be increased.

Furthermore, as the vibration transmission portion 112 is abutting the back surface of the panel P, the vibration transmission portion 112 converts the expansion and contraction of the piezoelectric elements PZ lying along the longitudinal direction (Y-axis direction) of the piezoelectric elements PZ into vibration of a direction perpendicular to the plane (Z-axis direction) and transmits it to the back surface of the panel P (see an arrow 1103 in FIG. 20).

In other words, the vibration transmission portion 112 gathers in the center of the diaphragm 111 the vibration that is converted into the direction perpendicular to the plane as the diaphragm 111 warps by following the expansion and contraction of the piezoelectric elements PZ, and transmits it to the back surface of the panel P.

Accordingly, the occurrence of vibration in an opposite phase in the panel P can be reduced. That is, the sound pressure frequency characteristics of the panel P can be improved.

Figure 21:
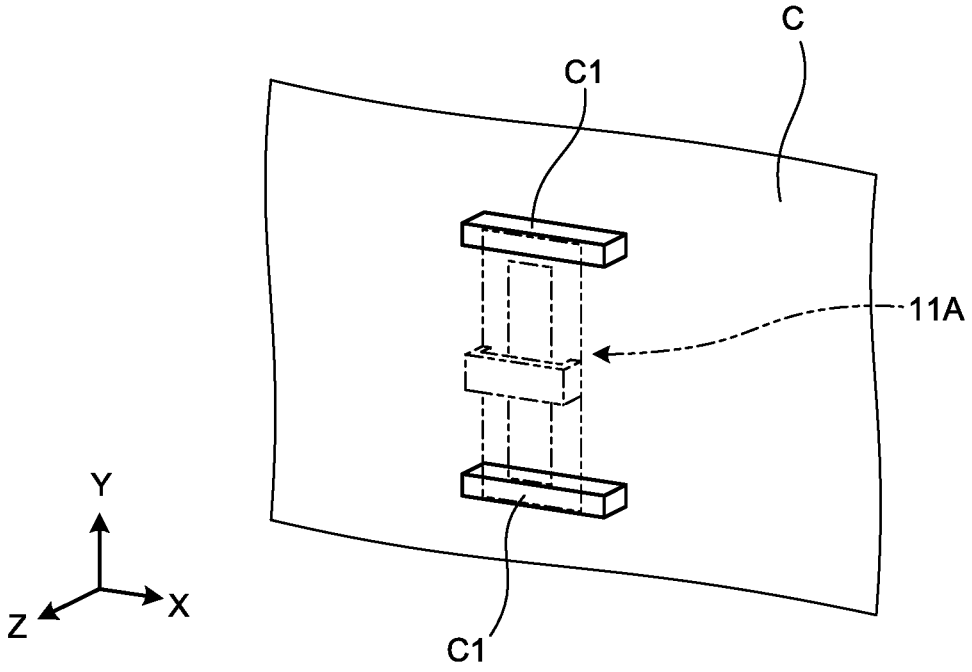
FIG. 21 to FIG. 23 are diagrams (part 1 to part 3) illustrating configuration examples of a positioning portion in the second embodiment.
Figure 22:
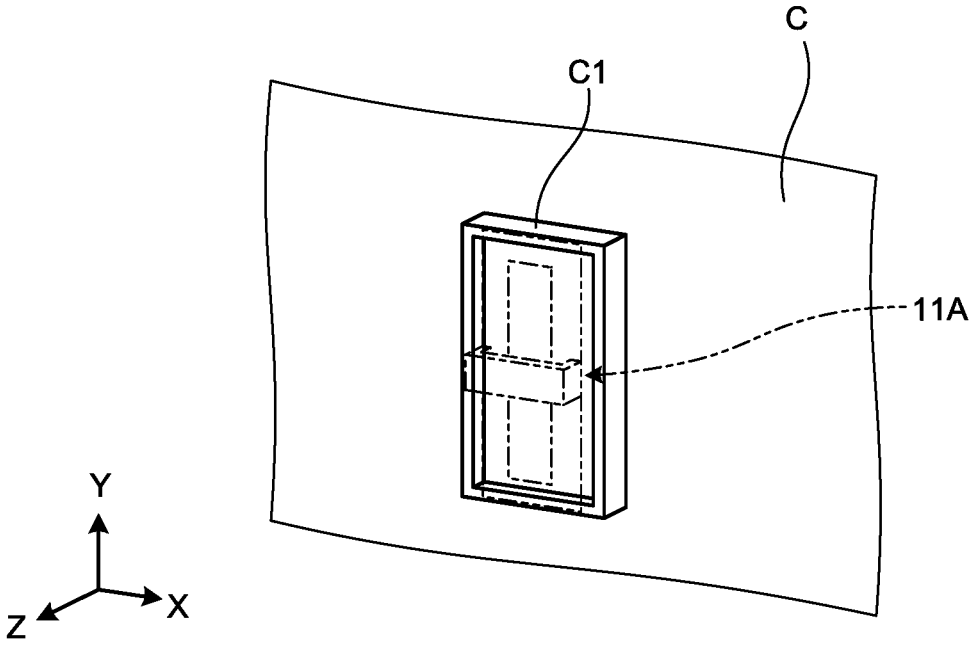
Figure 23:
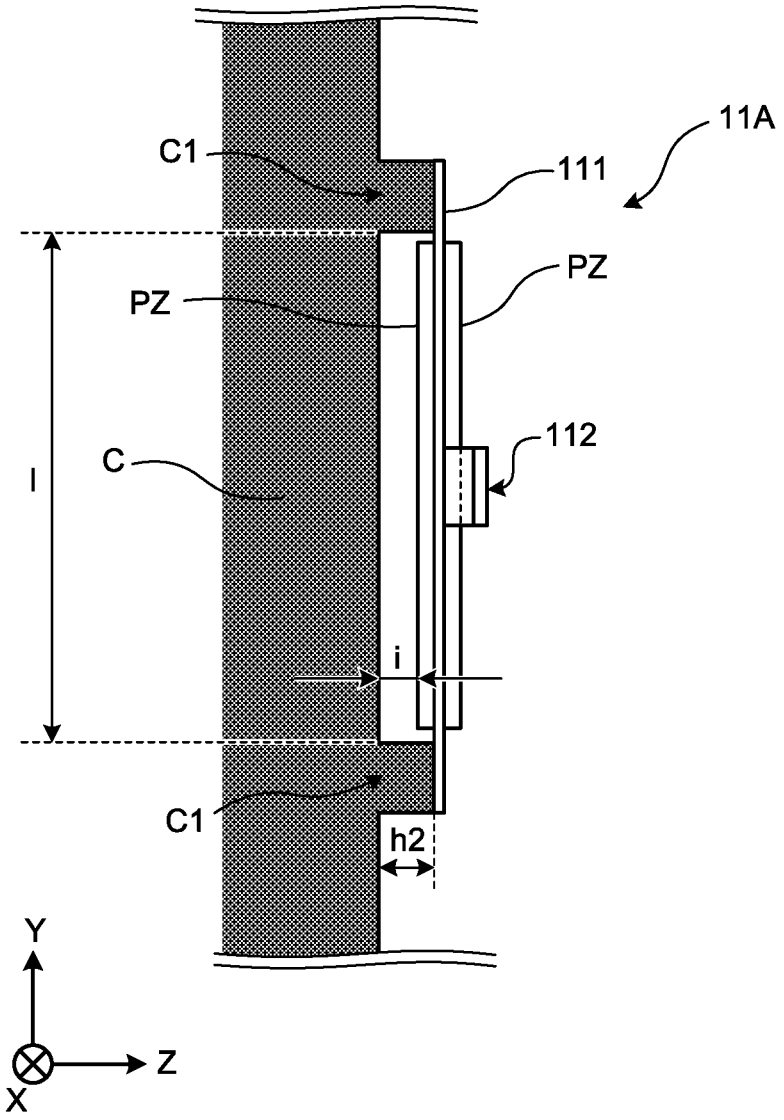

Next, a more specific configuration example of the positioning portion C1 in the second embodiment will be described with reference to FIG. 21 to FIG. 23. FIG. 21 to FIG. 23 are diagrams (part 1 to part 3) illustrating the configuration examples of the positioning portion C1 in the second embodiment.

As illustrated in FIG. 21, the positioning portions C1 are, at the predetermined positions in the chassis C, provided projecting from the chassis C as in the foregoing. That is, the positioning portions C1 are formed as a projecting portion projecting toward the panel. P from the chassis C.

The positioning portions C1 can be formed, so as to be able to support the two M2 portions (margin areas on both end portions in the longitudinal direction of the diaphragm 111) illustrated in FIG. 18, at positions corresponding to the M2 portions as two projecting portions extending parallel to the X-axis direction as illustrated in FIG. 21, for example.

Furthermore, so as to be able to support the two M2 portions in the same manner, as illustrated in FIG. 22 for example, the positioning portions C1 can be formed as a projecting portion in a frame-like shape composed of two upper and lower sides that are parallel to the X-axis direction supporting the M2 portions, and of two left and right sides that are parallel to the Y-axis direction and for which the interval is greater than the measurement in the lateral direction of the diaphragm 111.

Note that, in either case of FIG. 21 and FIG. 22, a projecting measurement h2 of the positioning portion C1 is a measurement that can ensure a clearance i for the above-described vibration space that does not disturb the vibration of the diaphragm 111, as illustrated in FIG. 23.

Incidentally, the clearance i is greater than the maximum amount of displacement of the diaphragm 111 toward the negative direction of the Z-axis and the measurement h2 is set so as to be greater than such a clearance i. The length 1 between the two positioning portions C1 is set so as to be greater than the measurement in the longitudinal direction (Y-axis direction) of the piezoelectric element PZ and smaller than the measurement in the longitudinal direction (Y-axis direction) of the diaphragm 111.

As the positioning portion C1 is thus configured, with respect to the chassis C, the actuator 11A can be attached to an appropriate predetermined position easily while ensuring the clearance i for the vibration space. Thus, it can contribute to improving the vibration characteristics of the panel P.

Modification of Positioning Portion C1

Until now, it has been exemplified that the positioning portion C1 is formed as a projecting portion projecting toward the panel. P from the chassis C. However, the positioning portion C1 is not limited thereto and may be formed as a recessed portion that is recessed with respect to the chassis C. Such a modification will be described with reference to FIG. 24 to FIG. 26.

Figure 24:
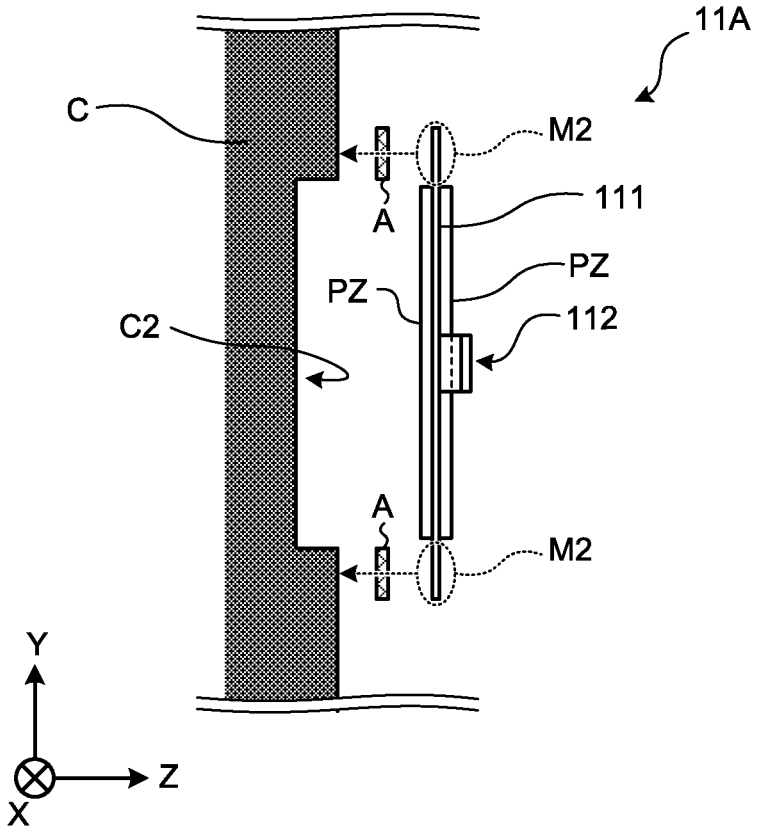
FIG. 24 to FIG. 26 are diagrams (part 1 to part 3) illustrating a configuration example of a positioning portion in a modification.
Figure 25:
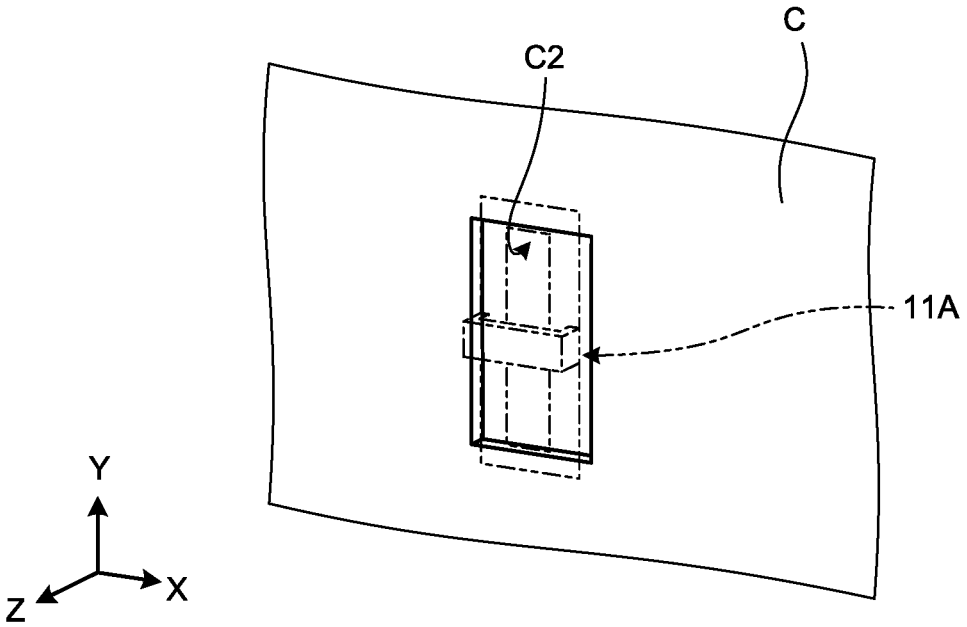
Figure 26:
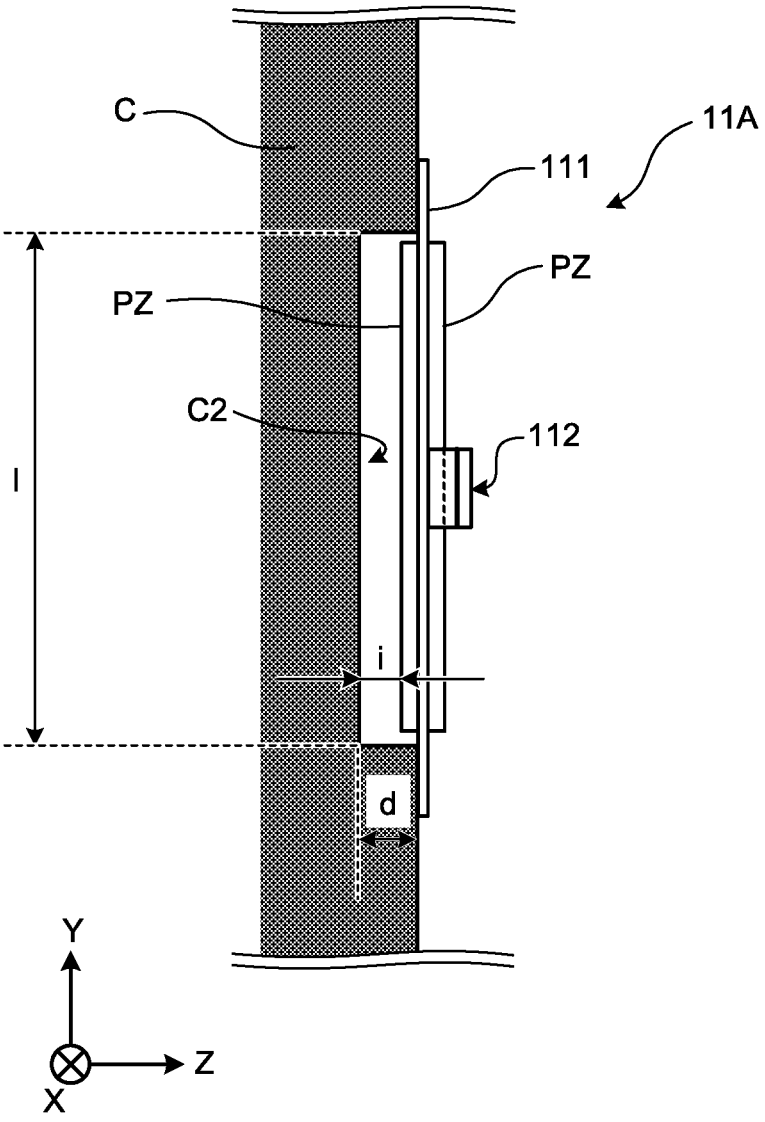

FIG. 24 to FIG. 26 are diagrams (part 1 to part 3) illustrating a configuration example of a positioning portion C2 in the modification. As illustrated in FIG. 24 and FIG. 25, the positioning portion C2 is, at the predetermined position in the chassis C, formed as a recessed portion that is recessed with respect to the chassis C.

In such a case, as illustrated in FIG. 24, the actuator 11A is secured to the chassis C by securing the M2 portions to an edge portion of the positioning portion C2 by using the adhesive material A.

Note that, as illustrated in FIG. 26, a recessed measurement d of the positioning portion C2 is a measurement that can ensure the clearance i for the above-described vibration space. That is, the measurement d is set so as to be greater than such a clearance i. The length 1 in the longitudinal direction (Y-axis direction) of the positioning portion C2 is the same as the length 1 illustrated in FIG. 23.

As the positioning portion C2 is thus configured, with respect to the chassis C, the actuator 11A can be attached to an appropriate predetermined position easily while ensuring the clearance i for the vibration space. Thus, it can contribute to improving the vibration characteristics of the panel P.

As in the foregoing, the display speaker 10A (corresponds to one example of "speaker device") in the second embodiment includes the panel P, the diaphragm 111, and the chassis C. The diaphragm 111 is equipped with the piezoelectric elements PZ, and is provided so as to vibrate the panel P by vibrating by the excitation of such piezoelectric elements PZ. The chassis C supports the diaphragm 111. Furthermore, the chassis C is provided with the positioning portion C1 or C2 that positions such a diaphragm 111 to the predetermined position while ensuring the vibration space of the diaphragm 111.

Thus, according to the display speaker 10A in the second embodiment, the vibration characteristics of the panel P can be improved.

Furthermore, the diaphragm 111 has the areas of non-contact with the piezoelectric elements PZ, the non-contact areas being formed on at least both end portions, and the positioning portion C1 or C2 is formed so as to support the above-described non-contact areas of the both end portions. Consequently, according to the display speaker 10A in the second embodiment, the piezoelectric elements PZ can be excited without being disturbed. That is, the vibration characteristics of the panel P can be improved.

Furthermore, the positioning portion C1 or C2 is formed at a position where the positioning portion C1 or C2 is possible to support the diaphragm 111 at the above-described predetermined position at which the panel P vibrates at the maximum efficiency by the diaphragm 111, the predetermined position being set beforehand. Consequently, according to the display speaker 10A in the second embodiment, the panel P can be made to vibrate efficiently. That is, the vibration characteristics of the panel P can be improved.

Furthermore, as the positioning portions C1 and C2 are formed as a projecting portion projecting toward the panel P from the chassis C or a recessed portion that is recessed with respect to the chassis C, the vibration space is ensured. Consequently, according to the display speaker 10A in the second embodiment, the diaphragm 111 can be made to vibrate while ensuring the vibration space. That is, the vibration characteristics of the panel P can be improved.

Furthermore, the positioning portions C1 and C2 have a projecting measurement as a projecting portion or a recessed measurement as a recessed portion that is greater than the maximum amount of displacement of the diaphragm 111. Consequently, according to the display speaker 10A in the second embodiment, the diaphragm 111 can be made to vibrate without being disturbed. That is, the vibration characteristics of the panel P can be improved.

Furthermore, the positioning portion C1 is formed as a plurality of projecting portions extending in parallel. In addition, the positioning portion C1 is formed as a projecting portion of a frame-like shape. Thus, according to the display speaker 10A in the second embodiment, a mistake in attaching can be prevented by clearly indicating the attaching position of the actuator 11A to a worker and it can contribute to improving the vibration characteristics of the panel P.

In addition, the display speaker 10A in the second embodiment further includes the vibration transmission portion 112 extending from the above-described non-contact area of the diaphragm 111 and provided so as to abut the back surface of the panel P. Consequently, according to the display speaker 10A in the second embodiment, the occurrence of vibration in an opposite phase in the panel P can be reduced and the vibration characteristics of the panel P can be improved.

Third Embodiment

Figure 27:
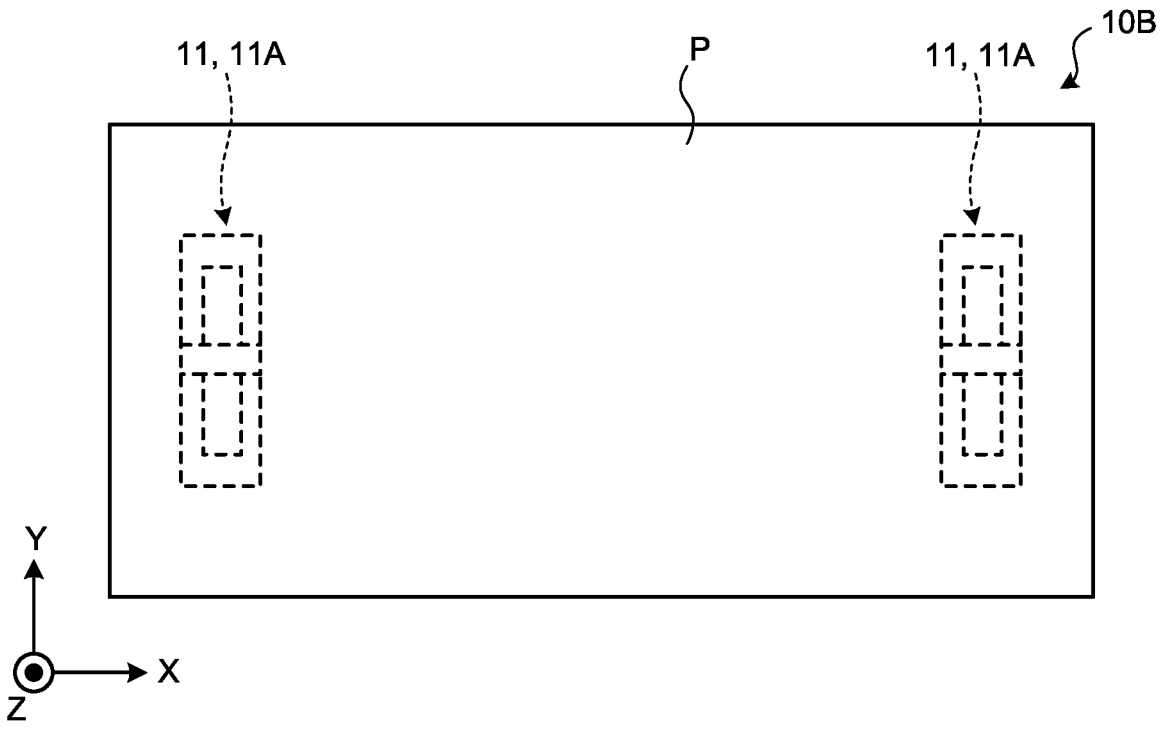
FIG. 27 is a schematic front view illustrating an overview of a configuration of a display speaker according to a third embodiment.

FIG. 27 is a schematic front view illustrating an overview of a configuration of a display speaker 10B according to a third embodiment. Until now, it has been exemplified that a single piece of the actuator 11 or 11A is provided in, for example, the central portion of the back surface of the panel P. However, the embodiments are not limited thereto.

That is, as illustrated in FIG. 27, the display speaker 10B can be provided with the actuator 11 or 11A each in the vicinity of both end portions in the longitudinal direction (X-axis direction) of the panel P, for example.

As a result, stereophonic reproduction of sound can be carried out, for example. When the display speaker 10B is installed on a passenger compartment of a vehicle, by providing each actuator 11 or 11A in the vicinity of both end portions of an instrument panel (instrument board) for example, effective stereophonic reproduction of sound can be provided to the driver.

Furthermore, in each of the above-described embodiments, it has been described that the piezoelectric elements PZ are provided on each of the principal surfaces of the diaphragm 111. However, the piezoelectric element PZ only needs to be provided on at least one of the principal surfaces of the diaphragm 111.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speaker device, comprising:

a panel; and an actuator disposed on the panel, the actuator including:

a diaphragm;

a piezoelectric element disposed on one of principal surfaces of the diaphragm, the piezoelectric element having: a longitudinal direction in a plan view of the panel, a transverse direction in the plan view perpendicular to the longitudinal direction, and a central portion in the longitudinal direction; and a vibration transmission portion disposed on the one of the principal surfaces of the diaphragm and abutting the panel without making contact with the piezoelectric element, the vibration transmission portion contacting the diaphragm at a location separated from the piezoelectric element and aligned in the transverse direction with the central portion of the piezoelectric element.

2. The speaker device according to claim 1, wherein the piezoelectric element is also disposed on another of the principal surfaces of the diaphragm, and configured so that when a voltage is applied to the piezoelectric element, phases of vibration of the principal surfaces are opposite to each other at a time of driving.

3. The speaker device according to claim 1, wherein the vibration transmission portion is disposed in a center of the diaphragm.

4. The speaker device according to claim 1, wherein the vibration transmission portion has a substantially U-like shape.

5. The speaker device according to claim 1, wherein the vibration transmission portion has a substantially arch-like shape.

6. The speaker device according to claim 1, wherein the vibration transmission portion has a plurality of protrusions projecting from the diaphragm.

7. The speaker device according to claim 1, wherein the vibration transmission portion is disposed in a center in a longitudinal direction of the diaphragm, and a leg portion is disposed on a shorter side of a rear surface side of the vibration transmission portion.

8. The speaker device according to claim 1, wherein the vibration transmission portion has a bridge shape and spans over the piezoelectric element.

9. A speaker device comprising:

a panel;

a diaphragm;

a piezoelectric element disposed on one of principal surfaces of the diaphragm, and provided so as to vibrate the panel by vibrating by excitation of the piezoelectric element, the piezoelectric element having: a longitudinal direction in a plan view of the panel, a transverse direction in the plan view perpendicular to the longitudinal direction, and a central portion in the longitudinal direction;

a chassis supporting the diaphragm, the chassis being provided with a positioning portion that positions the diaphragm to a predetermined position while ensuring a vibration space of the diaphragm; and a vibration transmission portion disposed on the one of the principal surfaces of the diaphragm and abutting the panel without making contact with the piezoelectric element, the vibration transmission portion contacting the diaphragm at a location separated from the piezoelectric element and aligned in the transverse direction with the central portion of the piezoelectric element.

10. The speaker device according to claim 9, wherein the diaphragm has areas of non-contact with the piezoelectric element, the non-contact areas being formed on at least both end portions, and the positioning portion is formed so as to support the non-contact areas on the both end portions.

11. The speaker device according to claim 10, wherein the positioning portion is formed at a position where the positioning portion is possible to support the diaphragm at the predetermined position at which the panel vibrates at maximum efficiency by the diaphragm, the predetermined position being set beforehand.

12. The speaker device according to claim 10, wherein the positioning portion ensures the vibration space by being formed as a projecting portion projecting toward the panel from the chassis or a recessed portion that is recessed with respect to the chassis.

13. The speaker device according to claim 12, wherein the positioning portion has a projecting measurement as the projecting portion or a recessed measurement as the recessed portion that is greater than a maximum amount of displacement of the diaphragm.

14. The speaker device according to claim 10, wherein the vibration transmission portion is provided so as to extend from the non-contact area of the diaphragm and abut a back surface of the panel.

15. A speaker device, comprising:

a panel;

an actuator including:

a diaphragm;

a piezoelectric element disposed on one of principal surfaces of the diaphragm, and provided so as to vibrate the panel by vibrating by excitation of the piezoelectric element, the piezoelectric element having: a longitudinal direction in a plan view of the panel, a transverse direction in the plan view perpendicular to the longitudinal direction, and a central portion in the longitudinal direction; and a vibration transmission portion disposed on the one of the principal surfaces of the diaphragm and abutting the panel without making contact with the piezoelectric element, the vibration transmission portion contacting the diaphragm at a location separated from the piezoelectric element and aligned in the transverse direction with the central portion of the piezoelectric element; and a chassis supporting the diaphragm, the chassis being provided with a positioning portion that positions the diaphragm to a predetermined position while ensuring a vibration space of the diaphragm.

16. The speaker device according to claim 15, wherein the diaphragm has areas of non-contact with the piezoelectric element, the non-contact areas being formed on at least both end portions, and the positioning portion is formed so as to support the non-contact areas on the both end portions.

17. The speaker device according to claim 16, wherein the positioning portion is formed at a position where the positioning portion is possible to support the diaphragm at the predetermined position at which the panel vibrates at maximum efficiency by the diaphragm, the predetermined position being set beforehand.

18. The speaker device according to claim 16, wherein the positioning portion ensures the vibration space by being formed as a projecting portion projecting toward the panel from the chassis or a recessed portion that is recessed with respect to the chassis.

19. The speaker device according to claim 18, wherein the positioning portion has a projecting measurement as the projecting portion or a recessed measurement as the recessed portion that is greater than a maximum amount of displacement of the diaphragm.

20. The speaker device according to claim 16, wherein the vibration transmission portion is provided so as to extend from the non-contact areas and abut a back surface of the panel.

* * * * *